US006073558A

United States Patent [19]

Jones

[11] Patent Number: 6,073,558

[45] Date of Patent: Jun. 13, 2000

[54] PRINTING PRESS HAVING BLANKET CYLINDER WITH FILLER BAR AND BLANKET

[75] Inventor: Jackson Hacker Jones, Rochester, N.H.

[73] Assignee: Heidelberger Druckmaschinen AG, Heidelberg, Germany

[21] Appl. No.: 09/119,196

[22] Filed: Jul. 20, 1998

[51] Int. Cl.[7] ..... B41F 27/12

[52] U.S. Cl. ..... 101/415.1; 428/909

[58] Field of Search ..... 101/415.1, 217, 101/375, 376; 428/909

[56] References Cited

U.S. PATENT DOCUMENTS

| | | | |
|---|---|---|---|
| 2,121,309 | 6/1938 | Wale | 101/415.1 |
| 2,578,406 | 11/1951 | Dutro | 101/415.1 |
| 3,276,365 | 10/1966 | Langer | 101/415.1 |
| 3,353,481 | 11/1967 | Antonucci | 101/415.1 |
| 3,495,531 | 2/1970 | Thatcher | 101/415.1 |
| 3,633,246 | 1/1972 | Kirkpatrick | 101/415.1 |
| 3,765,329 | 10/1973 | Kirkpatrick et al. | 101/415.1 |
| 3,782,281 | 1/1974 | Darnall, Jr. | 101/415.1 |
| 4,357,868 | 11/1982 | Pabodie | 101/415.1 |
| 4,833,986 | 5/1989 | Kobler | 101/415.1 |
| 5,503,072 | 4/1996 | Schneider | 101/415.1 |
| 5,644,985 | 7/1997 | Serain et al. | 101/415.1 |
| 5,653,169 | 8/1997 | Puschnerat | 101/415.1 |
| 5,791,244 | 8/1998 | Tognino | 101/415.1 |

OTHER PUBLICATIONS

Brochure: Press Register Lockup Systems, K&F Printing Systems Int'l, ©Copyright 1996, 4 pages.

*Primary Examiner*—Edgar Burr
*Assistant Examiner*—Leslie J. Grohusky
*Attorney, Agent, or Firm*—Kenyon & Kenyon

[57] ABSTRACT

A printing press includes a combination printing blanket and blanket cylinder having a fill-in bar adapted to receive both ends of the printing blanket. The printing blanket and the fill-in bar are preattached, and, after wrapping the blanket around the cylinder, a barbed snap fit is achieved to fastened the blanket tightly around the cylinder.

17 Claims, 3 Drawing Sheets

PRINTING PRESS HAVING BLANKET CYLINDER WITH FILLER BAR AND BLANKET

FIELD OF THE INVENTION

The present invention relates to printing presses and more particularly to offset printing presses.

RELATED TECHNOLOGY

In the field of rotary offset printing presses, typically, an inker mechanism supplies ink via a series of rotary vibrator and form rolls to a printing plate which is mounted on plate cylinder. The plate cylinder is rotatably mounted in a frame of the press. A blanket cylinder is also rotatably mounted in the frame of the press, with the axis of the blanket cylinder being substantially parallel to the axis of the plate cylinder. A printing blanket is mounted on the blanket cylinder. The printing blanket and printing plate are in contact with each other at their respective circumferences, and thus have a rolling contact by which an image is transferred from the plate to the blanket during operation of the printing press.

Ink from the inker mechanism is applied to the plate cylinder. The inked image of the plate cylinder is then transferred to the printing blanket as the plate rotates into contact with the blanket. The blanket in turn rotates into contact with the substrate or web of material upon which the ink is printed. A similar arrangement of inker rolls, plate cylinder, and blanket cylinder may be placed on the other side of the web in order to print on both sides of the web simultaneously. Alternatively, an impression roll may be placed on the opposite side of the web for one-sided printing.

The printing plate is typically a relatively thin, flat, flexible metallic material. The plate may have a length slightly longer than the circumference of the plate cylinder upon which the plate will be mounted, and a width approximately equal to the width of the plate cylinder. The printing plate is mounted to the plate cylinder by wrapping the printing plate around the circumference of the plate cylinder and tucking the edges of the printing plate into a lock-up mechanism on the plate cylinder.

Printing blankets are typically made of a flexible rubber material, often having multiple layers including, for example, a base rubber layer, a compressible rubber layer, and a printing rubber surface layer. A printing blanket may be a flat blanket that is wrapped around the circumference of the printing cylinder with the edges of the printing blanket tucked into a lock-up mechanism on the blanket cylinder.

Lock-up mechanisms of various types are generally known in the art, such as disclosed by U.S. Pat. No. 5,503,072 to Schneider. A gap typically forms at the lock-up mechanism where the edges of the printing plate or printing blanket are tucked into the lock-up mechanism, which must then be mechanically operated.

SUMMARY OF THE INVENTION

The present invention provides an offset printing press comprising a blanket cylinder, the blanket cylinder having an axially extending slot, and a fill-in bar having a gap with at least one side having a ridged surface. A flat blanket is also provided which has at least one lock section, the lock section having at least one ridge for interacting with the ridged surface of the at least one side of the gap. Preferably a plurality of ridges are provided on the ridged surfaces of the one side and/or on the lock section, so that as the blanket is inserted into the gap, a tightening of the blanket about the blanket cylinder occurs. The fill-in bar advantageously is first bonded to the flat blanket at one end before insertion.

An advantage of the present invention is that it provides a flat blanket that can be mounted on a blanket cylinder with a relatively small gap. Because the gap is small, a phenomenon known as "gap bounce" (dynamic forces resulting from the interaction of the gap with the surface of the opposing cylinder, causing vibration and the like) may be reduced. The reduction of gap bounce eliminates the need for cylinder bearers. Typically, cylinder bearers are needed at each end of the printing cylinders in order to maintain a fixed distance between the centers of the rotating cylinders and avoid the effects of gap bounce. The present invention eliminates the need for cylinder bearers by reducing the occurrence of gap bounce.

The present invention also eliminates the need for a rod and reel mechanism, which required a complicated mechanical device. With the present invention a simple lock-up of the blanket can be achieved. This is achieved by the ridges being forced into the gap in a barbed manner so that a tight fit is achieved. In other words, as the blanket stretches, the ridges are ratcheted into the gap.

The blanket advantageously has at least one backing layer, a compressible rubber layer over the backing layer and a print layer over the compressible layer. A first lock molded into the blanket can attach the backing layer to the fill-in bar. A different lock section can be used to attach the barbed or ridged lock section to the backing layer.

The fill-in bar is shimmed or attached to the bottom of the slot of the blanket cylinder, so that the top of the fill-in bar is level with the outer surface of the blanket cylinder. The top surface of the fill-in bar advantageously is curved to match the curve of the outer surface of the blanket cylinder.

DETAILED DESCRIPTION

Figure 1:
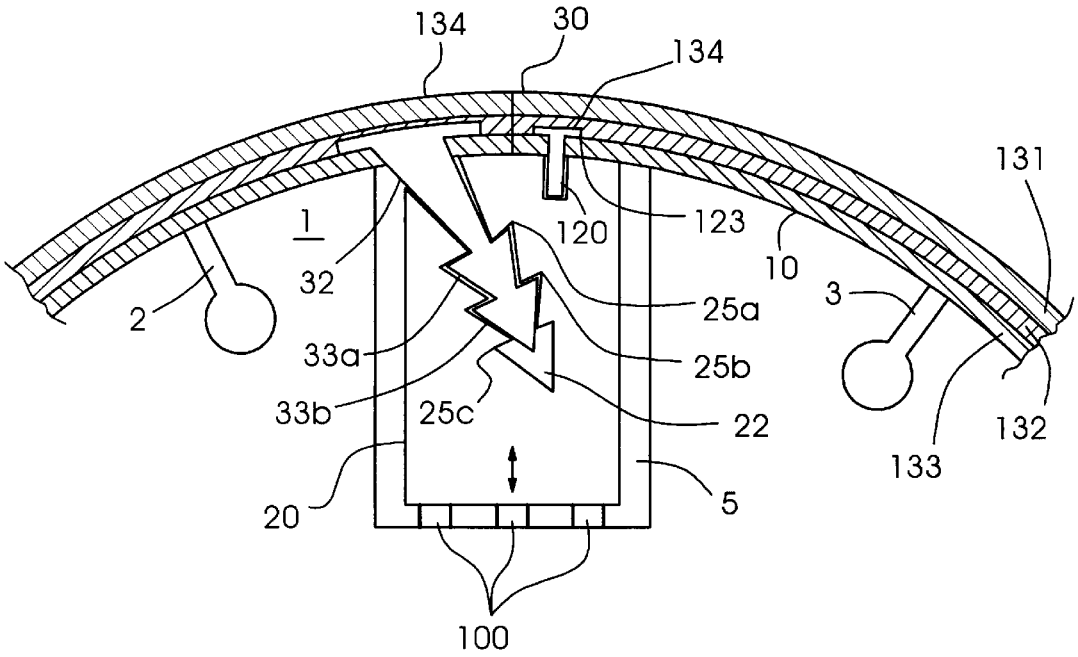
FIG. 1 shows a partial view of a blanket cylinder and fill-in bar and blanket of the present invention.

FIG. 1 shows a partial view of a blanket cylinder 1 which has a slot 5. The blanket cylinder 1 can be made of steel and the slot 5 can be machined into an outer surface 10 of the blanket cylinder 1. A fill-in bar 20 is attached to a blanket 30, which has a print layer 131 of, for example, smooth rubber, a compressible layer 132 of, for example, rubber with voids, and a backing layer 133, made for example from a fabric material. A lock 134 at one end of the blanket 30 extends from the compressible layer through the backing layer 133 and into a groove 120 of the fill-in bar 20. The lock 134 may extend axially along the blanket and be made, for example, of a polymeric material. A glue or other adhesive, for example, may bond the lock 134 into the groove 120, so that the fill-in bar 20 and the blanket 30 are preattached. The fill-in bar 20 and blanket 30 may then be placed in the slot 5, and attached to the bottom of the slot 5 in a shimming area. A shimming mechanism 100, for example a plurality of pneumatically-driven screws located at the bottom of the gap 5, can fasten the fill-in bar 20 to the blanket cylinder 1.

The shimming mechanism 100 can move the fill-in bar 20 up and down through the rotation of the screws so that a top surface 123 of the fill-in bar can be flush with the outer surface 10. The top surface 123 advantageously has a curved profile, the curve of the profile having a radius equal to the radius of the cylinder 1.

The fill-in bar 20 also has a gap 22 for holding the trail edge 34 of the blanket 30. The gap 22 has a plurality of ridges or barbs 25*a*, 25*b*, 25*c* on at least one side of the gap 22.

Figure 2:
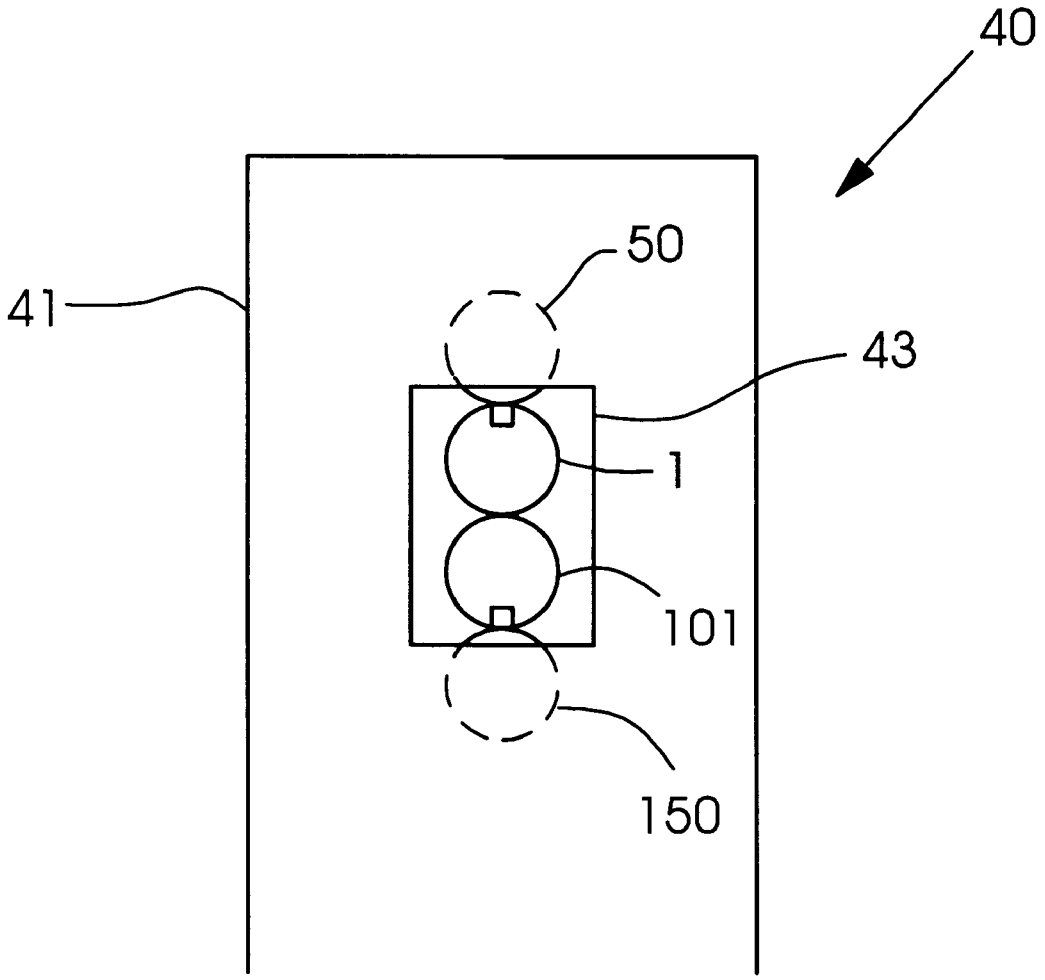
FIG. 2 shows a side view of a frame of the printing press of the present invention.
Figure 3:
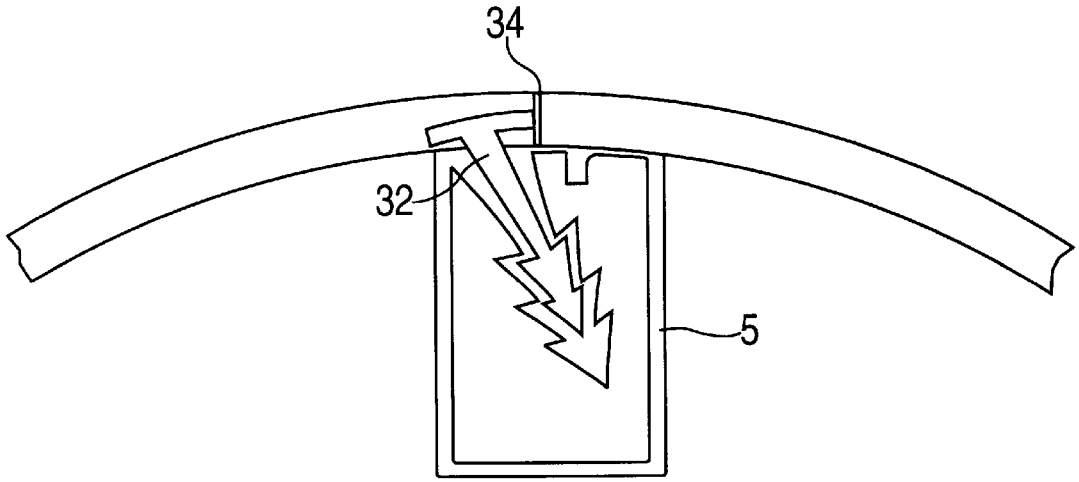
FIG. 3 shows a partial view of another embodiment of a blanket cylinder and fill-in bar and blanket of the present invention.

A distance from trail edge 34 blanket 30 has a lock section 32 on which at least one barb or ridge 33*a*, 33*b* is provided (FIG. 2). Alternatively, lock section 32 may be located directly at trail edge 34 of blanket 30 (FIG. 1). The lock section 32 extends axially and may be made of a polymeric material. The lock section 32 extends from the compressible layer 132 through the backing layer 133 so as to be firmly attached and part of the blanket 30. To manufacture the blanket, both the lock section 32 and the lock 134 can be placed through the backing layer 133 and then the compressible layer 132 can be applied, and if necessary, leached to provide voids. The print layer 131 can then be applied.

To install the blanket 30 and the fill-in bar 20, which are preattached through the lock 134, a press operator inserts the fill-in bar 20 into the slot 5 of the blanket. The shimming mechanism 100 attaches the fill-in bar 20 to the blanket cylinder 1, and the top surface 123 is shimmed even with the surface 10. The blanket cylinder 1 is then rotated, typically by running the press at a creeping speed, so that the blanket 30 wraps tightly around the surface 10. This wrap may be aided by contact of the blanket 30 with an impression cylinder. The lock section 32 of the blanket 30 is then fit into the gap 22. Due to stretching of the blanket 30, the ridges 33*a*, 33*b* of the edge or lock section 32 are ratcheted down the ridges 25*a*, 25*b*, 25*c* in a barbed manner to create a tight fit which holds the blanket 30 tightly on the blanket cylinder 1.

Advantageously, any gap at the external surface of the blanket is rather small and permits a press in which bearers for reducing vibrations are not necessary. The need for a complicated ratchet or rod and reel mechanism is also eliminated.

FIG. 2 shows an offset press 40 having a frame 41, a first plate cylinder 50, the blanket cylinder 1, a second blanket cylinder 101 and a second plate cylinder 150. An opening 43 in the frame 41 at the work-side of the press 40 may be provided for one or more of the blanket cylinders 1, 101, each of which may be constructed as described above.

To remove the blanket 30 from the blanket cylinder 1 (or 101) pressurized air may be provided through the plurality of air holes 2, 3 (FIG. 1) so that the blanket 30 expands and the blanket 30 and fill-in bar 20 may be axially removed through the opening 43. The opening 43 may also be provided with a door to provide additional support for the cantilevered cylinders 1, 101 during printing.

It is to be understood that the barbs or ridges of the gap 22 can be provided in many possible variations to permit a proper fit of the blanket 30. The lead edge of the blanket 30 and the groove 120 may also be ridged to provide for a firmer fit.

A gap or filler material may also be used to fill in any gap remaining at the outer surface of the blanket 30 after it is installed.

What is claimed is:

1. An offset printing press comprising:

a blanket cylinder, the blanket cylinder having an axially extending slot;

a fill-in bar having a gap with at least one side having a ridged surface; and a blanket having at least one lock section, the lock section having at least one ridge for interacting with the ridged surface of the at least one side of the gap, the at least one ridge being ratcheted down the ridged surface in a barbed manner so as to create a tight fit.

2. The offset printing press as recited in claim 1 wherein the ridged surface includes a plurality of ridges.

3. The offset printing press as recited in claim 1 wherein the lock section is located a distance from a trail edge of the blanket.

4. The offset printing press as recited in claim 1 wherein the at least one side includes two sides with ridged surfaces.

5. The offset printing press as recited in claim 1 further comprising a shimming mechanism for adjusting a location of the top surface of the fill-in bar.

6. The offset printing press as recited in claim 1 wherein the at least one ridge includes a plurality of ridges.

7. The offset printing press as recited in claim 1 further comprising a frame, the blanket cylinder being mounted in the frame, and the frame including an opening for axially removing the blanket.

8. The offset printing press as recited in claim 1 wherein the lock section is located directly at a trail edge of the blanket.

9. A blanket comprising:

a print layer; and at least one lock section, the lock section having at least one ridge for interacting with a ridged surface to fasten the blanket to a blanket cylinder, the at least one ridge being ratcheted down the ridged surface in a barbed manner so as to create a tight fit.

10. The blanket as recited in claim 9 wherein the at least one ridge includes a plurality of ridges.

11. The blanket as recited in claim 9 wherein the lock section is located directly at a trail edge of the blanket.

12. The blanket as recited in claim 9 wherein the lock section is located a distance from a trail edge of the blanket.

13. The blanket as recited in claim 9 further comprising a compressible layer and a backing layer.

14. A blanket-fill-in bar combination comprising:

a fill-in bar for fitting into a slot of a blanket cylinder, the fill-in bar having a groove; and a blanket, an end of the blanket fixedly attached in the slot, and the blanket having a lock section at another end, the lock section having at least one ridge;

the fill-in bar further having a gap with at least one side having a ridged surface for interfacing with the lock section, the at least one ridge being ratcheted down the ridged surface in a barbed manner so as to create a tight fit.

15. The combination as recited in claim 14 wherein the ridged surface includes a plurality of ridges.

16. The combination as recited in claim 14 wherein the blanket further includes a lock, the lock for attaching the end of the blanket.

17. The combination as recited in claim 14 wherein the blanket includes a print layer a compressible layer, and a backing layer.

* * * * *